United States Patent [19]

Thomas et al.

[11] 4,190,952

[45] Mar. 4, 1980

[54] INSULATION DISPLACEMENT CONNECTOR ADAPTER

[75] Inventors: Philip J. Thomas, Costa Mesa; John A. McAllister, Mission Viejo, both of Calif.

[73] Assignee: Circuit Assembly Corp., Costa Mesa, Calif.

[21] Appl. No.: 919,462

[22] Filed: Jun. 27, 1978

[51] Int. Cl.[2] ..... H01R 43/00; H01R 43/04

[52] U.S. Cl. ..... 29/629; 29/749; 339/99 R

[58] Field of Search ..... 29/629, 749; 339/210 M, 339/198 R, 206 R, 198 G, 107, 99 R

[56] References Cited

U.S. PATENT DOCUMENTS

| | | | |
|---|---|---|---|
| 3,444,506 | 5/1969 | Wedekind . | |
| 3,680,032 | 7/1972 | Mosier et al. . | |
| 3,891,013 | 6/1975 | Folk et al. | 29/749 X |
| 3,990,767 | 11/1976 | Narozny . | |
| 4,026,014 | 5/1977 | Sugimoto et al. | 339/198 G X |
| 4,076,365 | 2/1978 | Ross | 339/107 |
| 4,108,526 | 8/1978 | McKee | 339/206 R X |

FOREIGN PATENT DOCUMENTS

| | | | |
|---|---|---|---|
| 1047040 | 11/1966 | United Kingdom | 339/198 G |

*Primary Examiner*—Francis S. Husar
*Assistant Examiner*—C. J. Arbes
*Attorney, Agent, or Firm*—Knobbe, Martens, Olson, Hubbard & Bear

[57] ABSTRACT

This invention relates to a device for adapting between an insulation displacement connector of one pitch and a standard plug or socket connector of another pitch using conductor inserts uniformly stamped and accurately offset to accommodate the difference in pitch by insertion into a molded insert guide.

5 Claims, 14 Drawing Figures

INSULATION DISPLACEMENT CONNECTOR ADAPTER

BACKGROUND OF THE INVENTION

The term "insulation displacement" as used in this specification refers generally to the method of forming an electrical connection with an insulated connector by the use of any device which simultaneously pierces the insulation and forms an electrical connection with the conductor. Such a device is disclosed in U.S. patent application Ser. No. 866,181, the disclosure of which is incorporated herein by reference.

This patent relates to insulation displacement technology which is applied to multiconductor flat cables typically used as computer signal lines. These cables are often relatively small in size and include closely spaced conductors. The use of insulation displacement technology for the termination of multiconductor flat cables is well known in the industry. This technology has provided a fast and inexpensive method for connecting and terminating multiconductor flat cables and is described in numerous patents. One long-standing problem in the art has been caused by the fact that the spacing between conductors within multiconductor flat cables and the spacing between conductors within termination connectors have not been standardized throughout the industry.

The prior art has attempted to solve this problem with the use of adaptive connectors for connecting between connectors having one spacing or pitch and connectors having another spacing or pitch. The word "pitch" is used in this specification as a synonymous term with the phrase "spacing between conductors." In the prior art, such adaptive connectors were formed by using a connector body housing plural conductive inserts, with each insert being individually and uniquely formed to provide a precise amount of offset. Each insert typically has two connectively engageable ends which are relatively offset to correspond with the difference in pitch between the two connectors or cables to be connected by the adaptive connector. Such an offset is cumulative for a connector involving a plurality of such conductive inserts. Thus, each insert had an individually unique amount of offset, and the prior art was forced to manufacture such adaptive connectors using the expensive process of individually forming each conductive insert. Therefore, an adaptive connector involving, for example, 15 conductors, would typically have 15 uniquely formed, or uniquely stamped, conductive inserts, each insert having a unique place for location within the connective adaptor.

As is apparent from the above, the prior art adaptive connectors involve very expensive manufacturing costs, involving different tooling for each conductive insert for each connective adapter. Furthermore, the actual process of fabrication was expensive because each conductive insert had a unique position in the adaptive connector, and any error in location or emplacement of such a conductive insert into the adaptive connector would result in a defective adaptive connector, incapable of making the desired connection between conductors or cables of a different pitch. It was seemingly apparent to the prior art that fabrication of an adaptive connector necessarily required differently formed conductive inserts for each conductive insert to be inserted into the connective adapter. Thus, the prior art taught that such an adaptive conductor could not be fabricated from plural uniformly stamped conductive inserts.

Other prior art involved an even more expensive method of essentially wiring together two sets of connectors of a different pitch, requiring the individual soldering of wires between conductive inserts.

SUMMARY OF THE INVENTION

This invention provides a more reliable, and less expensive, adaptive connector for connecting between an insulation displacement connector of one pitch and a standard plug or socket connector of another pitch. This invention avoids the problems encountered in the prior art by use of novel structural features which allow such an adaptive connector to be formed from identically stamped conductive inserts. The invention also eliminates dependence upon manufacturing operator's skill in shaping the conductive inserts to accommodate the difference in pitch. The elimination of the dependence of the manufacturing process on the manufacturing operator's skill raises the reliability of the fabrication method and the manufacturing yield.

The preferred embodiment of this invention includes features disclosed for the insulation displacement connector, a subject of U.S. patent application Ser. No. 866,181, filed by the applicants of this patent application. In particular, the preferred embodiment includes a set of uniformly stamped conductive inserts, each forming an insulation displacement connector at one end and forming either a socket or a pin connector at the other end. The conductive insert is preferably stamped from a thin copper sheet or strip.

In order to accommodate the difference in pitch between the insulation displacement connector at one end of the adaptive connector and the standard connector at the other end of the adaptive connector, an offset must be formed between the ends of each conductive insert. Thus, the insulation displacement connector end of the conductive insert must be laterally offset from the pin or socket connector end of the conductive insert. At the same time, the ends of the insert must remain substantially relatively parallel. This lateral offset is achieved without uniquely stamping the uniformly stamped set of conductive inserts. Instead, the conductive inserts are inserted into an integrally molded plastic insert guide having receptacle areas for receiving the conductive inserts. Each receptacle area has a non-linear configuration into which the stamped conductive insert is easily inserted. During insertion, each insert is automatically bent to form the lateral offset unique to the conductive insert. Thus, the unique lateral offset necessary for each conductive insert is easily achieved by incorporating the correct amount of lateral offset for each insert into the configuration of each molded receptacle area of the insert guide. The amount of lateral offset accumulates with the number of conductive inserts. For example, if the plug connector of an adaptive connector has a pitch of 0.109 inch between centers or a given plug row and the insulation displacement connector of the adaptive connector has a pitch of 0.100 inch between the centers of respective conductors, then, assuming the plug end and the insulation displacement end of the center insert are not offset with respect to each other, the insulation displacement end and plug end of the adjacent insert will be offset from one another by 0.109 inch, and the next pair of ends will be offset by 0.218 inch, with the offset increasing or accumulating by 0.009 inch for each additional insert and plug pair. It is therefore necessary that the configuration of each receptacle area be molded differently, each receptacle area giving a different amount of lateral offset to the conductive insert inserted therein.

In the prior art the accommodation of the cumulative offset was accomplished by forming each conductive insert individually, and then selectively placing each uniquely or formed conductive insert into its proper location within the connector. As is seen from the foregoing, the accommodation of the cumulative offset in this invention is done less expensively by means of a molded insert guide for receiving identically stamped conductive inserts which automatically shapes each conductive insert to the desired lateral offset according to the position of the conductive insert within the insert guide. Because the insert guide is cheaply molded from a single die, the expense in fabricating the adaptive connector of this invention is very small in comparison with the costs incurred in the prior art adaptive connectors.

In the preferred embodiment of this invention, a plurality of identically molded or stamped conductive inserts formed from a single copper sheet or strip are each inserted into one of a plurality of receptacle areas provided in the insert guide. After a conductive insert has been inserted into each of the receptacle areas of the insert guide, the insert guide itself is then inserted into an adaptive connector body. As a result, the plurality of insulation displacement connector ends of the conductive inserts extends externally of one surface of the adaptive connector body, forming an insulation displacement connector. The opposite surface of the adaptive connector body has either pins or socket connectors exposed at the surface, thereby forming a standard pin or socket connector at the other end of the adaptive connector body. Because of the lateral offsets formed in the conductive inserts, the pitch of the insulation displacement connector end of the adaptive connector body will differ from the pitch of the pin or socket connector formed on the other end of the adaptive connector body. Each pitch is selected to correspond respectively to the pitch of the multiconductor cable to be connected and the standard pin or socket connector to be connected, respectively.

This invention also includes a novel feature which solves the problem present in the prior art due to the fact that the plane of the flat copper conductive insert must be perpendicular to the axis of symmetry of the conductors of the multiconductor cable to be connected using the method of the prior art insulation displacement connection. The design of a feasible adaptive connector requires that the flat copper insert be bent along an axis parallel to the axes of symmetry of the conductors of the multiconductor cable in order to achieve the suitable lateral offset corresponding to the pitch differential between the multiconductor cable and the standard connector to be connected by the adaptive connector. Because of the fact that the bend in the flat conductive insert is preferably formed along an axis parallel to the flat plane of the conductive insert, it would seem in the prior art that the conductive insert must be twisted between the portion forming the insulation displacement connector and the portion which must be bent to form the lateral offset corresponding to the pitch differential.

One novel feature of this invention comprises a new way to form an insulation displacement connector which eliminates the necessity of any twist in the conductive insert. This novel feature consists of two separated portions of the insulation displacement end of the conductive insert which are bent into two oppositely formed semi-cylinders forming an "S" pattern, thereby allowing insulation displacement of a multiconductor cable whose conductors have their axes of symmetry disposed in a direction parallel to the flat plane of the flat conductive insert. Elimination of the necessity for twisting the conductive insert eliminates the twist as an expensive step in the fabrication of the adaptive connector, thereby saving production costs. The resulting connector is also more reliable, since the twist suggested by the prior art weakens the insert.

The use of straight, uniformly stamped inserts which are bent upon insertion into the connector body causes each insert to elastically compress against the connector body after insertion, thereby preventing itself from falling out of the connector body during production. This facilitates the fabrication of the connector and minimizes production costs.

Elimination of the twist in the conductive insert maximizes the length of the insert which is available for bending. This length is determined by (a) the overall length of the insert, (b) the length of the insulation displacement end, and (c) by the length of the plug or socket end. If no twists are required, the available bending length is increased for a given size connector. Maximizing the length of the insert which is available for bending increases the bending radius necessary to achieve the desired lateral offset. This decreases the amount of force required to bend the inserts during installation of the inserts into the adaptive connector body, thereby facilitating the fabrication of the connector, reducing the cost, and reducing the bending fatigue.

Figure 3:
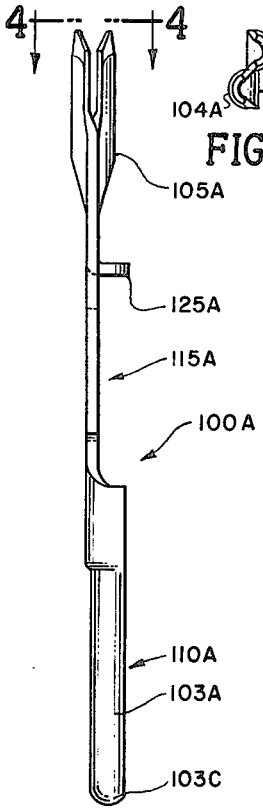
FIG. 3 is a plan view of the conductive insert formed from the blank of FIG. 2 having an insulation displacement connector at its upper end and a standard pin connector at its lower end.
Figure 4:
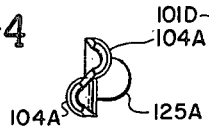
FIG. 4 is a view of the conductive insert of FIG. 3 taken along lines 4—4 of FIG. 3 clearly showing the S-shape of the insulation displacement prong.
Figure 5:
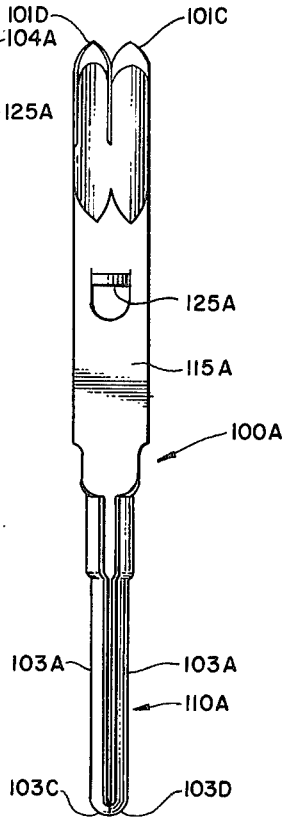
FIG. 5 is a side view of the conductive insert of FIG. 3.
Figure 7:
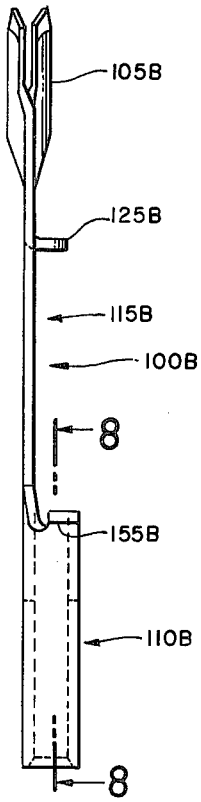
FIG. 7 is a plan view of the conductive insert formed from the blank of FIG. 6 having an insulation displacement connector at its upper end and a socket connector at its lower end.
Figure 8:
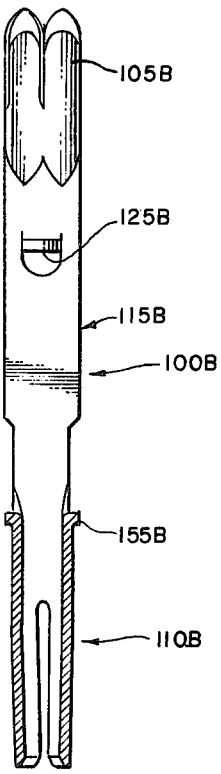
FIG. 8 is a partial cross-sectional view of the conductive insert of FIG. 7 taken along lines 8—8 of FIG. 7 showing the interior configuration of the standard socket connector of the conductive insert of FIG. 7.
Figure 9:
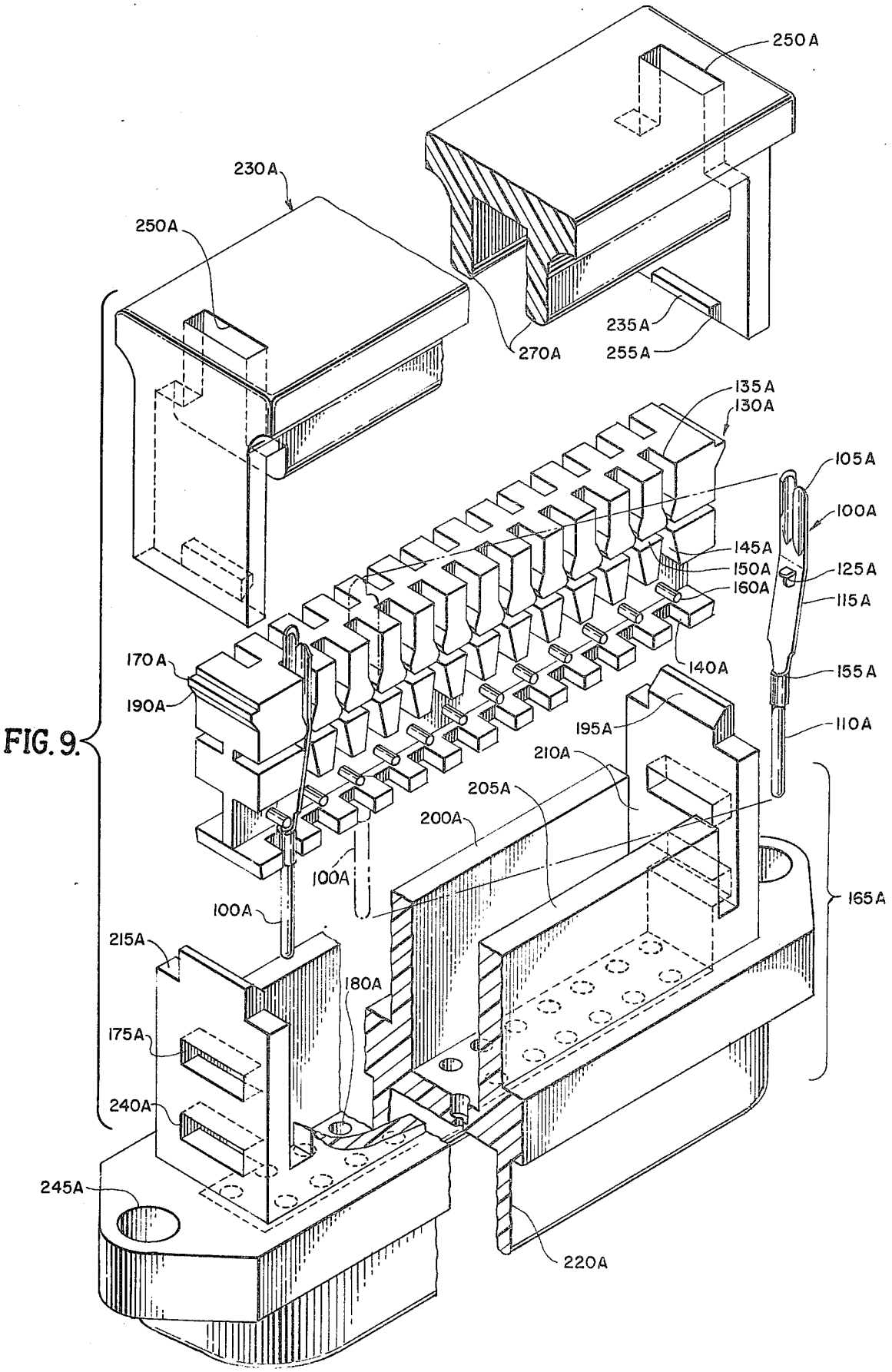
Figure 10:
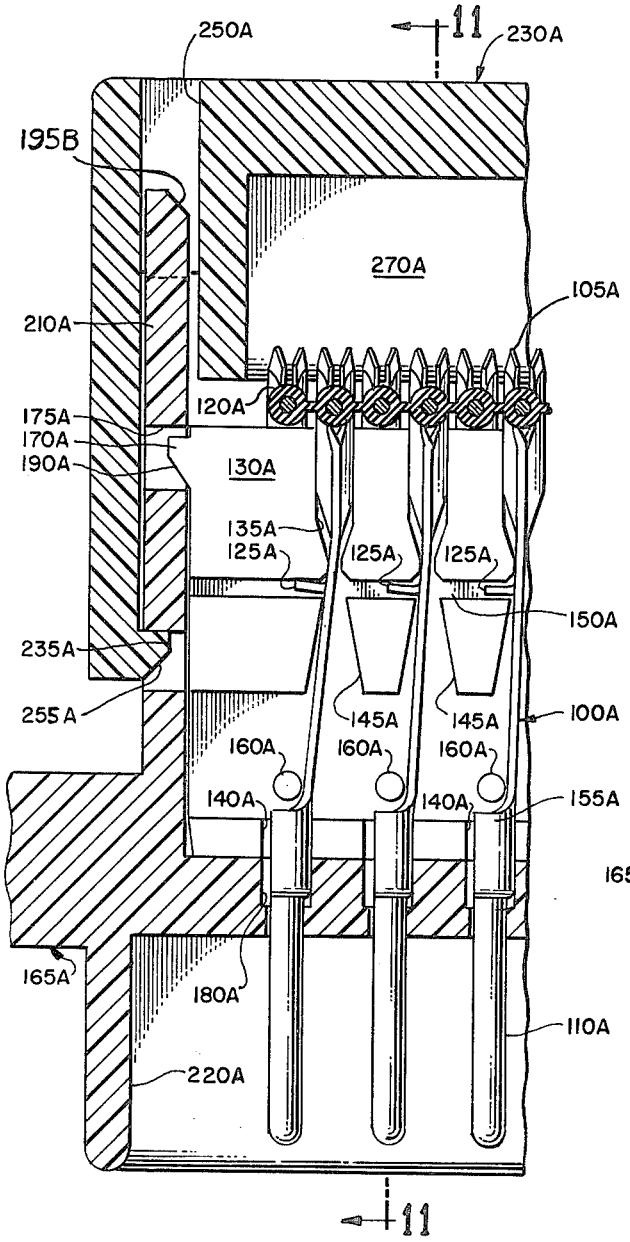
Figure 11:
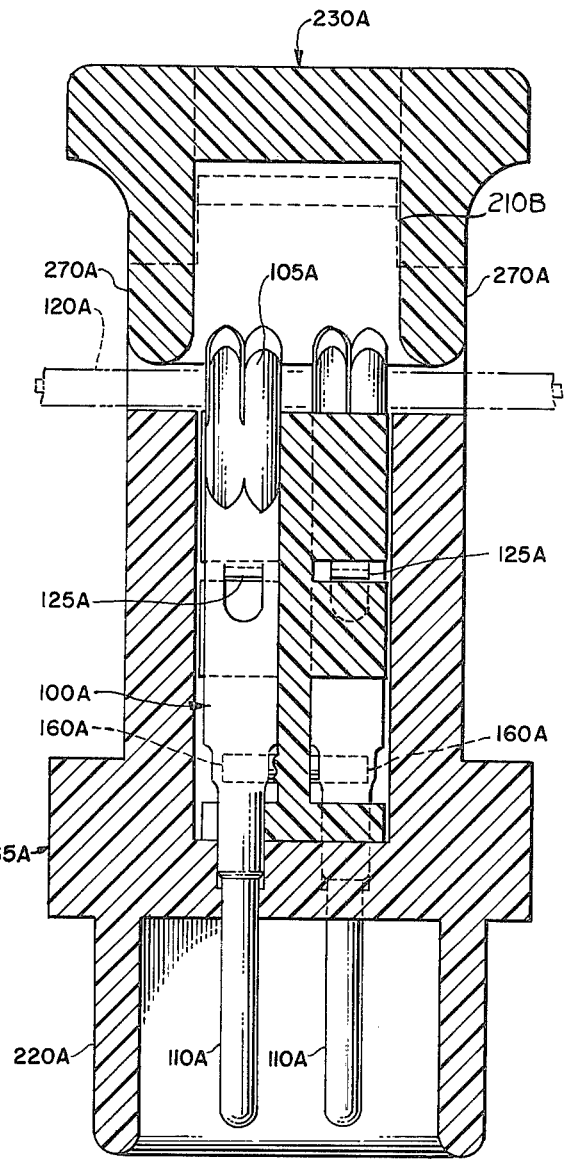
Figure 12:
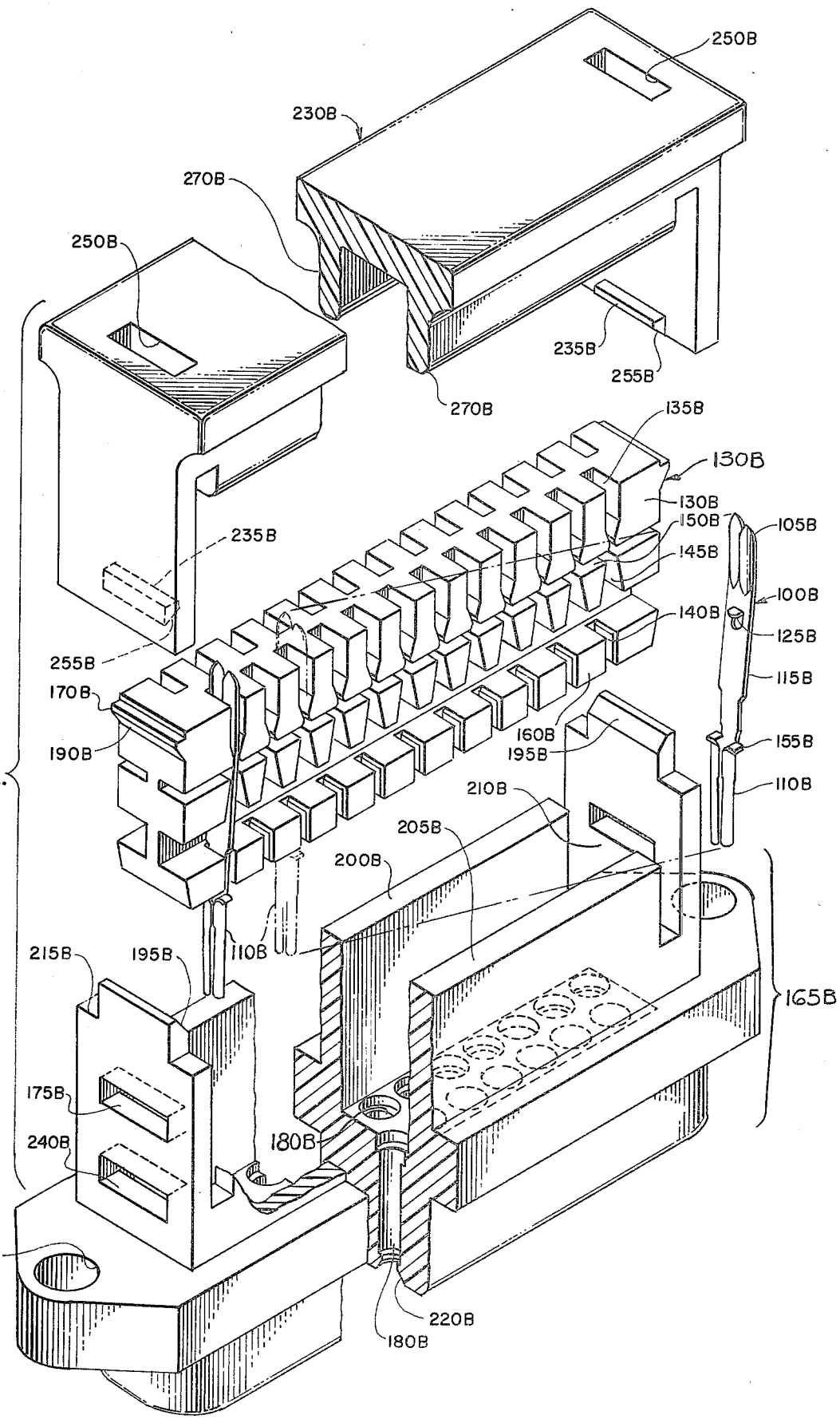
Figure 13:
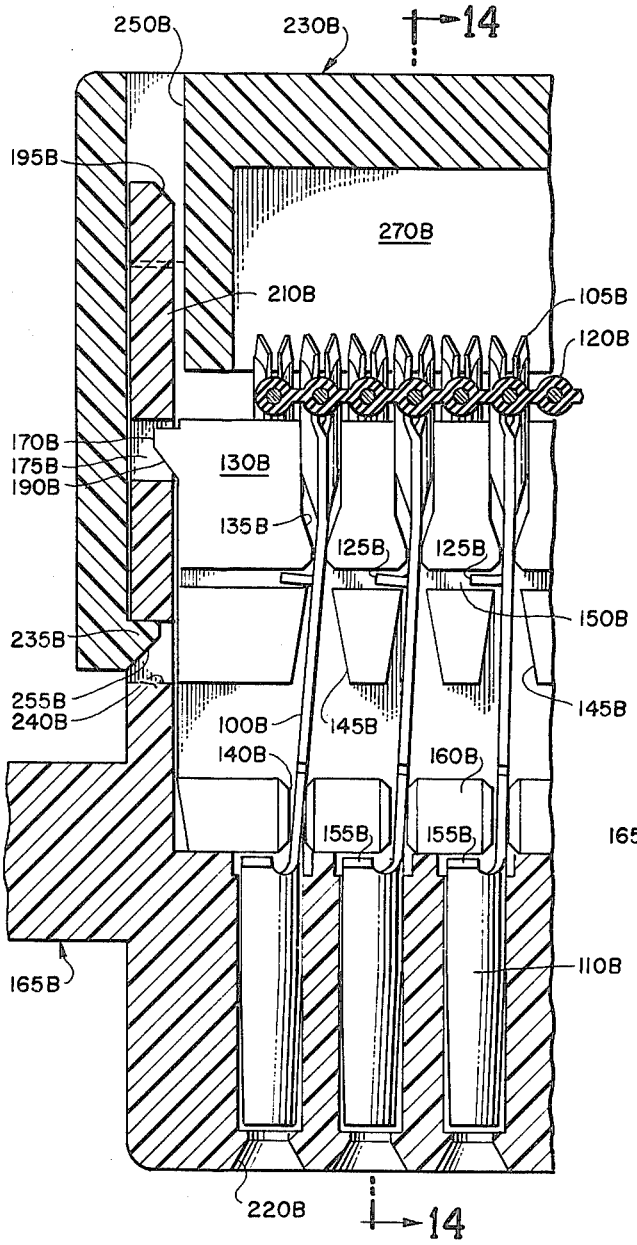
Figure 14:
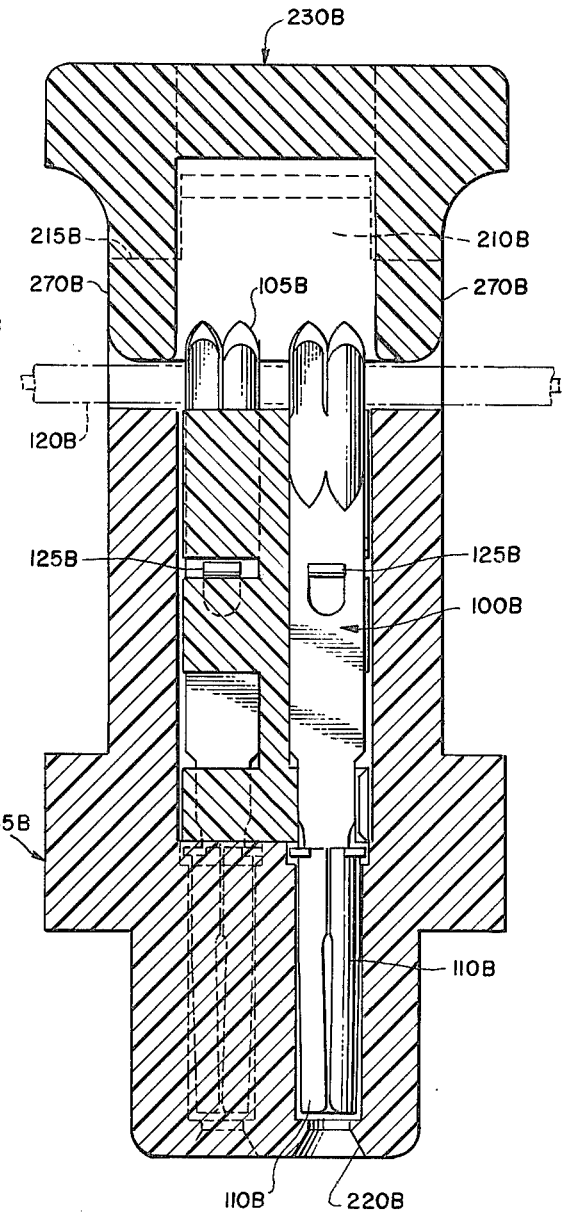

FIG. 9 is an exploded perspective view of the adaptive connector of this invention in which some parts are shown in partially cutaway cross-section, the adaptive connector of FIG. 9 intended for use with the conductive insert having the standard pin connector illustrated in FIGS. 3, 4, and 5;

FIG. 10 is a sectional view of the adaptive connector of FIG. 9 as fully assembled;

FIG. 11 is a sectional view of the fully assembled adaptive connector of FIG. 10 taken along lines 11—11 of FIG. 10;

FIG. 12 is an exploded perspective view of the adaptive connector of this invention in which some parts are shown in partially cutaway cross-section, the adaptive connector of FIG. 12 intended for use with the conductive insert of FIGS. 7 and 8 having the standard stocket connector formed at one end;

FIG. 13 is a sectional view of the fully assembled adaptive connector of FIG. 12; and FIG. 14 is a sectional view of the fully assembled adaptive connector of FIG. 13 taken along lines 14—14 of FIG. 13.

DESCRIPTION OF THE PREFERRED EMBODIMENT

Figure 1:
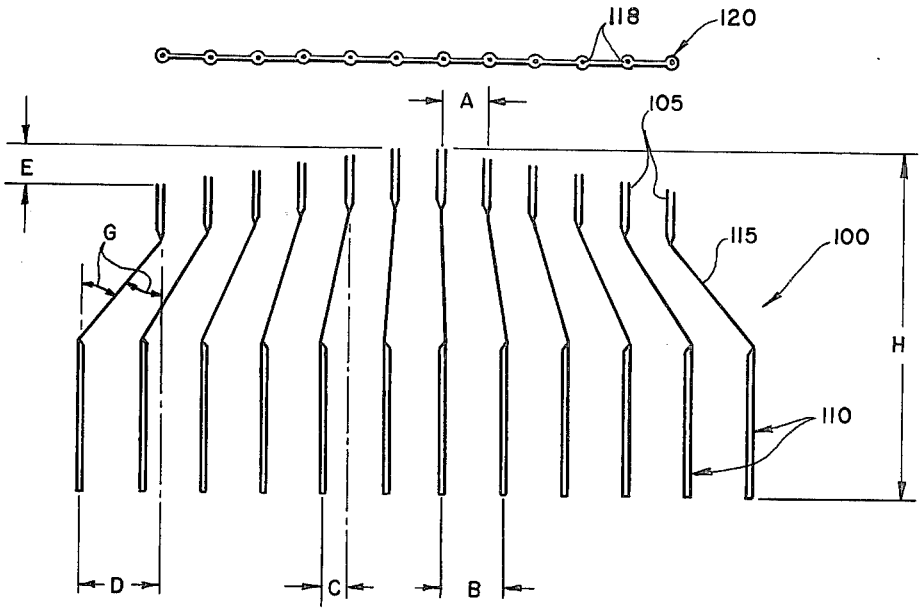
FIG. 1 is a schematic diagram of the general concept of an adaptive connector, clearly showing the difference in pitch between the insulation displacement connectors at the top and the standard connectors at the bottom of the adaptive connector and clearly showing the cumulative offset of each conductive insert.

The basic concept of an adaptive connector is illustrated in the schematic diagram of FIG. 1. FIG. 1 shows a series of conductive inserts 100 placed side by side, each forming an insulation displacement connector 105 at one end, and standard connector 110 at the opposite end. Each conductive insert 100 has a bending portion 115. The purpose for the adaptive connector is to accommodate the difference between the pitch A of the insulation displacement connectors 105 and the pitch B of the standard connectors 110. This difference in pitch is dictated by the spacing, or pitch, of conductors 118 of a multiconductor flat cable 120, and by the pitch of a standard socket with which the standard connector ends 110 must interconnect. As illustrated in FIG. 1, if it is assumed that the group of inserts 100 and the cable 120 are laterally aligned, the center conductive insert 100 has very little or no bend in it, such that its insulation displacement end 105 and standard connector end 110 are coaxial. In order to accommodate the difference between the pitch A and the pitch B, the adjacent conductive inserts must be bent to form a lateral offset as illustrated at C between the axes of the insulation displacement end 105 and the standard connector end 110. As can be seen from the schematic diagram of FIG. 1, the lateral offset, as illustrated at C, accumulates with the number of adjacent conductive inserts, reaching a maximum lateral offset D at the end of the connector.

As is evident from FIG. 1, even though the plural inserts 100 must be uniquely bent to accommodate this cumulative offset, the insulation displacement end 105 and standard connector end 110 of each insert 100 are mutually parallel. Thus, the insulation displacement ends 105 of the plural inserts 100 are parallel to one another, to facilitate insulation displacement. In addition, the connector ends 110 are parallel to one another, as is required for interfacing with other connectors.

Figure 2:
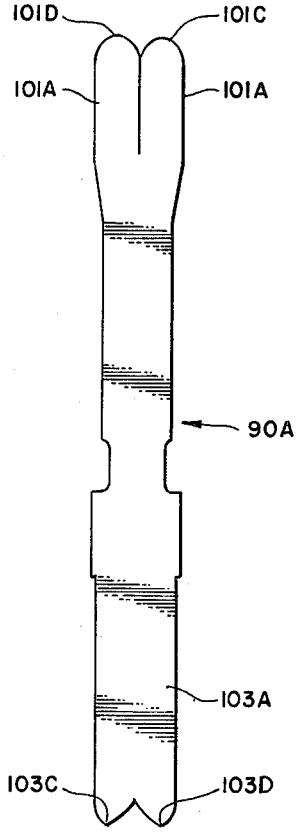
FIG. 2 is a plan view of the blank stamped of sheet metal from which the conductive insert of this invention having a standard pin at one end and an insulation displacement connector at the other end is formed.

FIG. 2 illustrates a sheet metal blank 90A from which any of the conductive inserts 100 may be formed. The sheet metal blank 90 has separate insulation displacement prong-forming leaves 101A and a standard pin connector-forming leaf 103A. The sheet metal blank 90A is formed to be the conductive insert 100A, illustrated in FIG. 3, having an insulation displacement connector 105A, the bending portion 115A, and a standard pin connector 110A.

FIG. 5 shows the bending of the pin-forming leaf 103A to form the pin 110A more clearly. The pin-forming leaf 103A has two pointed ends 103C,103D at its bottom. The leaf 103A is folded to form a cylinder as illustrated in FIG. 5, and the two pointed ends 103C and 103D meet together to form a single sharp end on the pin 110A.

The insulation displacement connector is formed from the blank 90A of FIG. 1 by folding each of the separate leaves 101A to form two oppositely disposed semi-cylinders 104A shown in FIG. 4. The leaves 101A of FIG. 2 are each slightly spaced from one another and have pointed ends 101C,101D at their tops. When the leaves 101A are folded into the semi-cylinders 104 of FIG. 4, they form a prong pair with sharp points 101C and 101D on each prong. The prong pair form the insulation displacement connector 105.

At this point, it is seen that the insulation displacement connector 105A and the standard pin connector 110A consist of portions of the sheet metal blank 90A which are folded, whereas the bending portion 115A is not folded. The folded portions 105A and 110A resist bending because they are folded and not planar. Thus, the insert 100A will naturally tend to react to any bending force by bending within the substantially planar bending portion 115A. A retention nub 125A extends normal to the bending portion 115, and is visible in FIGS. 3 and 5.

FIGS. 9 and 10 illustrate the assembly of the embodiment of this invention utilizing the conductive inserts having the standard pin connector on one end illustrated in FIGS. 3, 4, and 5. The conductive inserts 100A are each manually pressed or inserted into an insert guide 130A. During this operation, the insulation displacement connector 105A is received within an insulation displacement conductor guide 135A, the standard pin connector 110A is received within a standard pin connector guide 140A, and the bending portion 115A is received within a guide 145A. The insulation displacement connector guide 135A is offset from the corresponding pin connector guide 140A corresponding to the requisite lateral offset between the insulation displacement connector 105A and the standard pin connector 110A as illustrated in FIG. 1 at C and D. As illustrated in FIGS. 9 and 10, the retention nub 125A is received within a retention nub guide 150A. A top portion 155A of the standard pin connector 110A abuts a retention nub 160A formed in the insert guide 130A. Together, the retention nub 160A and the top portion 155A of the pin 110A restrain the conductive insert 100A against vertical movement within the insert guide 130A. Because the sheet metal conductive inserts 100A are bent upon insertion into the insert guide 130A, each insert 100A will elastically bias itself against the surfaces of the insulation displacement guide 135A, the guide 145A, and the standard pin connector guide 140A. This bias will retain the insert 100A within the insert guide 130A, thereby preventing accidental removal during fabrication. Thus, it may be seen that, as each insert 101A is manually pushed into the guide 130A, the connective insert guide 130A automatically provides an exact amount of lateral offset formed in each conductive insert 100A which is uniquely determined for each position of each conductive insert 100A within the insert guide 130A to accommodate the cumulative lateral offset, as illustrated in FIG. 1. Another row of conductive inserts 100A may be inserted into the opposite side of the insert guide 130A. As is illustrated in FIG. 9, this row is offset from the first row, such that every other conductor of the multiconductor cable to be connected to the insulation displacement connectors 105A is contacted by a conductive insert of each row. This feature permits the spacing between the plurality of guides 135A to be doubled.

As shown in FIGS. 9, 10, and 11, once all of the inserts 100A are in place, the insert guide 130A is inserted into an adaptive connector body 165A, and the guide 130A has a pair of latching dogs 170A received in receptacles 175A provided in the adaptive connector body 165A. The pins 110A simultaneously pass through holes 180A provided in the adaptive connector body 165A. Insertion of the insert guide 130A into the adaptive connector body 165A is facilitated by camming ramp surfaces 190A, provided on the insert guide 130A and camming ramp surfaces 195A, provided on the adaptive connector body 165A. These camming surfaces 190A and 195A cooperate to force the latching dogs 170A and the camming surfaces 195A to be resiliently displaced with respect to each other. Until the latching dogs 170A snap into the receptacles 175A. A cavity, illustrated in FIG. 9 as defined by walls 200A and 205A and legs 210A and 215A, retains the conductive inserts 100A within the insert guide 130A after insertion of the insert guide 130A into the adaptive connector body 165A. Walls 220A guide the insertion of a standard connector, not shown, for connection with the pins 110A extending to the bottom of the adaptive connector body 165A.

As shown in FIGS. 10 and 11, a multiconductor flat cable 120A is then placed over the insert guide 130A to form a connection with the insulation displacement connectors 105A extending above the insert guide 130A. A cover 230A is placed over the entire assembly and pressed down onto the cable 120A and the insert guide 130A after the insulation displacement connectors 105A have displaced the cable insulation and connected with the conductors of the cable 120A. The displacement of the cable insulation is accomplished by a fixture, not shown, which presses the cable 120A down onto the insulation displacement connectors 105A. The cover 230A is held in place by a latching dog 235A held in a receptacle 240A provided in each leg 210A of the connector body 165A. The legs 210A are received within a pair of leg receptacles 250A provided in the cover 230A. The installation of the cover 230A over the insert guide 130A and the adaptive connector body 165A is facilitated by camming surfaces 255A. Each camming surface 255A forces each latching dog 235A to be resiliently displaced with respect to each leg 210A until the latching dog 235A snaps into the receptacle 240A. Strain relief ribs 270A, illustrated in FIG. 9, press down on top of the cable 120A, as shown in FIGS. 10 and 11, and prevent movement of the cable 120A which would other wise result in bending or damage to the insulation displacement connectors 105A.

Holes 245A, shown in FIG. 9, are provided in the surface of the adaptive connector body 165A for attachment to a standard connector, not shown, connected to the pins 110A.

Figure 6:
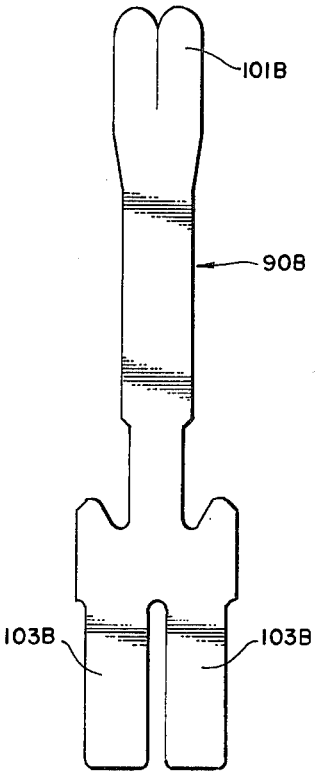
FIG. 6 is a plan view of the blank stamped of sheet metal from which the conductive insert of this invention having an insulation displacement connector at one end and a standard socket connector at its other end is formed.

FIG. 6 illustrates a sheet metal blank 90B from which a conductive insert of an alternative embodiment having features similar to the conductive inserts of FIGS. 3 and 5 is formed. The difference between the embodiments illustrated in FIGS. 3 and 5 and the embodiment illustrated in FIGS. 7 and 8 is that the standard connector 110B in FIGS. 7 and 8 is a standard socket connector instead of the standard pin connector 110A of FIGS. 3 and 5. Otherwise, the conductive insert of this alternative embodiment illustrated in FIGS. 7 and 8 has the same features as the conductive insert illustrated in FIGS. 3, 4, and 5, having an insulation connector 105B formed from insulation displacement prong-forming leaves 101B, the socket 110B being formed from socket-forming leaves 103B.

The insulation displacement connector is formed in the same way as described above for the conductive insert having the standard pin connector.

The standard socket connector 110B, illustrated in FIG. 7, is formed from the blank 90B of FIG. 6 by forming each of the leaves 103B into a semi-cylinder, so that the leaves 90B together form a complete cylinder with a hollow interior as the socket 110B, a cross-section of which is shown in FIG. 8. A thin bending portion 115B and a retention nub 125B is also illustrated in FIG. 7.

FIG. 12 illustrates the assembly of the embodiment of this invention utilizing the conductive inserts having the standard socket connector on one end illustrated in FIGS. 6, 7, and 8. The conductive inserts 100B are manually inserted into the insert guide 130B. The insulation displacement connector 105B is received within an insulation displacement conductor guide 135B, the standard socket connector 110B is received within a standard socket connector guide 140B, and the bending portion 115B is received within a guide 145B. The insulation displacement connector guide 135B is offset from the corresponding socket connector guide 140B corresponding to the requisite lateral offset between the insulation displacement connector 105B and the standard socket connector 110B as illustrated in FIG. 1 at C and D. Thus, during insertion, each insert 100B is automatically bent to provide the proper offset. As illustrated in FIGS. 12 and 13, the retention nub 125B is received within a retention nub guide 150B. A top portion 155B of the standard socket connector 110B abuts a block 160B formed in the insert guide 130B. Together, the block 160B and the top portion 155B of the socket 110B restrain the conductive insert 100B against vertical movement within the insert guide 130B. Because the sheet metal conductive inserts 100B are bent upon insertion into the insert guide 135B, each insert 100B will elastically bias itself against the surfaces of the insulation displacement guide 135B, the guide 145B, and the socket guide 140B. This bias will retain the insert 100B within the insert guide 130B, thereby preventing accidental removal during fabrication. Thus, it may be seen that as each insert 100B is manually pushed into the guide 130B, the connective insert guide 130B automatically provides an exact amount of lateral offset formed in each conductive insert 100B which is uniquely determined for each position of each conductive insert 100B within the insert guide 130B to accommodate the cumulative lateral offset, as illustrated in FIG. 1. Another row of conductive inserts 100B may be inserted into the opposite side of the insert guide 130B. As is illustrated in FIG. 12, this row is offset from the first row, such that every other conductor of the multiconductor cable to be connected to the insulation displacement connectors 105B is contacted by a conductive insert of each row.

This feature permits the spacing between the plurality of guides 135B to be doubled.

As shown in FIGS. 12, 13, and 14, the insert guide 130B is inserted into an adaptive connector body 165B, and has a pair of latching dogs 170B received in receptacles 175B provided in the adaptive connector body 165B. The socket connectors 110B pass through holes 180B provided in the adaptive connector body 165B. Insertion of the insert guide 130B into the adaptive connector body 165B is facilitated by camming ramp surfaces 190B, provided on the insert guide 130B and camming ramp surfaces 195B, provided on the adaptive connector body 165B. These camming surfaces 190B and 195B cooperate to force the latching dogs 170B and the camming surfaces 195B to be resiliently displaced with respect to each other until the latching dogs 170B snap into the receptacles 175B. A cavity, illustrated in FIG. 12 as defined by walls 200B and 205B and legs 210B and 215B, retains the conductive inserts 100B within the insert guide 130B after insertion of the insert guide 130B into the adaptive connector body 165B. Ramp surfaces 220B guide the insertion of a standard connector, not shown, for connection with the socket 110B extending to the bottom of the adaptive connector body 165B. As shown in FIGS. 13 and 14, a multiconductor flat cable 120B is then placed over the insert guide 130B to form a connection with the insulation displacement connectors 105B extending above the insert guide 130B. A cover 230B is placed over the entire assembly and pressed down onto the cable 120B and the insert guide 130B after the insulation displacement connectors 105B have displaced the cable insulation and connected with the conductors of the cable 120B. Displacement of the cable insulation is accomplished by a fixture, not shown, which presses the cable 120B onto the insulation displacement connectors 105B. The cover 230B is held in place by a latching dog 235B held in a receptacle 240B provided in the legs 210B of the connector body 165B. The legs 210B are received within a pair of leg receptacles 250B provided in the cover 230B. The installation of the cover 230B over the insert guide 130B and the adaptive connector body 165B is facilitated by the camming surfaces 255B. Each camming surface 255B forces each latching dog 235B to be resiliently displaced with respect to each leg 210B until the latching dogs 235B snaps into the receptacle 240B. Strain relief ribs 270B, illustrated in FIG. 12, press down on top of the cable 120B, as shown in FIGS. 13 and 14, and prevent movement of the cable 120B which would otherwise result in bending or damage to the insulation displacement connectors 105B.

Holes 245B, shown in FIG. 12, are provided in the surface of the adaptive connector body 165B for attachment to a standard connector, not shown, connected to the sockets 110B.

The fabrication of the adaptive connector of FIG. 1 may be facilitated by reducing the angle G through which each of the conductive inserts 100 is twice bent. For this purpose, this invention includes a unique feature which eliminates the necessity of twisting the conductive inserts 100.

Since any twisting of the conductive inserts 100 would have to occur within the bending portion 115 (and would otherwise interfere with the insulation displacement end 105 or standard connector end 110), such twisting would reduce the length of bending portion 115 which is available to form the offset illustrated in FIG. 1 in each of the conductive inserts 100. This would necessitate an increase in the angle of bending G to form the requisite amount of lateral offset C or D. Thus, elimination of twisting by decreasing the bending angle G can decrease production costs, reduce metal fatigue, and facilitate the fabrication of the adaptive connector.

Generally, the necessity for twisting the conductive inserts 100 arises from the parallel relationship between the axes of symmetry of the conductors 118 in the multiconductor cable 120 and the axes of bending of the conductive inserts 100 through the angle G. The prior art generally taught that the plane of the thin conductive insert 100 must lie perpendicular to the axes of symmetry of the conductors 118 of the multiconductor cable 120 in the region of the insulation displacement connector 105, while the remainder of the conductive insert is disposed with its plane parallel to the axes of bending formed by the angle G. Thus, the conductive insert would have to be twisted.

The unique feature which eliminates the necessity of twisting the conductive inserts 100 to form the adaptive connector of FIG. 1 is best seen in FIGS. 3, 4, and 7. FIG. 4 shows an insulation displacement connector 105A formed of two oppositely disposed semi-cylinders 104A. These semi-cylinders 104A efficiently displace the insulation of a multiconductor cable, 120 in FIG. 1, without requiring any twisting of the conductive insert 100A or 100B.

Normally, as stated before, the multiconductor flat cable, 120 in FIG. 1, would have to be disposed in a direction perpendicular to the plane of the thin conductive insert 100 in the region of the insulation displacement connector 105, thereby necessitating a twist being formed in the conductive insert 100A. However, as illustrated in FIG. 4, the insulation displacement portion utilizes two oppositely formed, semi-cylinders 104A to form the insulation displacement prongs of the insulation displacement connector 105A, thereby allowing the cable to be connected while disposed in a direction parallel to the plane of the thin conductive insert 100. The pointed ends 101C and 101D shown in FIG. 5 form sharp cutting edges which also serve to guide the conductors of the multiconductor cable to pass between the cutting edges of the semi-cylinders 104A to assure displacement of the insulation around the conductor. Since these sharp cutting edges lie in a plane perpendicular to the plane of the thin conductive insert 100, this feature causes the plane of the thin conductive insert 100 and the axes of the conductors of the multiconductor cable to be mutually parallel. This therefore eliminates any necessity of twisting the conductive insert 100. Not only does the unique design illustrated in FIG. 4 result in less bending of the conductive inserts to form the adaptive connector of FIG. 1, but also results in greater structural integrity of the conductive inserts, since the twisting of the conductive inserts otherwise reduces the strength of the inserts.

Because the conductive inserts 100, which are used to form the adaptive connector of FIG. 1, are all stamped uniformly and then bent individually to form the connector, and because the amount of bending for each conductive insert 100 is different, the conductive inserts 100 will be of non-uniform heighth, and the insulation displacement connectors 105 will have a maximum heighth difference E due to the cumulative lateral offset between C and D. This results in a reduction in the amount of force required to form an insulation displacement connection between the multiconductor flat cable 120 and the adaptive connector of FIG. 1.

We claim:

1. A method for fabricating a connector comprising:

forming a plurality of conductive inserts having a readily bendable central portion;

forming an insert guide having a plurality of insert receptacle areas, each of said receptacle areas having a different configuration from others of said receptacle areas and adapted to bend said central portion of any one of said conductive inserts to such configuration in an amount dependent upon its location in said guide; and inserting any one of said plurality of conductive inserts into any one of said receptacle areas, said insertion forcing said central portion of said one insert to bend conforming to said configuration of said one receptacle area.

2. A method for forming a connector comprising:

forming a plurality of uniform conductive inserts;

forming an insert guide having a plurality of spaced insert receptacle areas, each having a different configuration from others of said receptable areas and adapted to bend any one of said conductive inserts to said configuration; and inserting any one of said plurality of conductive inserts into any one of said plurality of receptacle areas, said inserting bending said insert to said configuration within said insert guide.

3. A method for making a connector comprising:

forming a plurality of uniform conductive inserts;

forming an insert guide having a top face, a bottom face, two side faces, and a plurality of laterally spaced receptacle areas with openings on at least one of said side faces, each of said receptacle areas formed to bend said inserts in an amount dependent upon its location in said guide;

inserting each of said plurality of conductive inserts into a respective one of said openings on said side face to bend said inserts to conform to the configuration of said receptacle areas; and covering said side faces by placing said insert guide within a connector body.

4. A method of forming an adapter for connecting a conductive device having a first pitch to a conductive device having a different second pitch, said adapter having an insert guide and plural inserts for installation within said insert guide, comprising:

forming a plurality of receptacle channels within said insert guide, said channels spaced from one another and formed so that the opposite ends of said channels coincide with said first and second pitches of said conductive devices, and inserting each of said inserts within a respective one of said receptacle channels to bend said inserts to conform to the configuration of said respective receptacle channel.

5. The method of claim 4 wherein said inserting step biases said inserts within said respective channels to maintain the opposite ends of said inserts in a position coinciding with said first pitch and said second pitch of said conductive devices.

* * * * *